US005351363A

United States Patent [19]

Appelgren

[11] Patent Number: 5,351,363

[45] Date of Patent: Oct. 4, 1994

[54] POPPET VALVE CLEANER

[76] Inventor: Dallas A. Appelgren, Box 88, Hillman, Mich. 49746

[21] Appl. No.: 934,965

[22] Filed: Aug. 25, 1992

[51] Int. Cl.[5] ..... A46B 13/02

[52] U.S. Cl. ..... 15/88.2; 15/21.1; 451/246; 451/252

[58] Field of Search ..... 15/88.2, 88.3, 88.4, 15/97.1, 21.1; 51/105 R, 105 VG, 241 A, 289 R, 94 R

[56] References Cited

U.S. PATENT DOCUMENTS

| | | | |
|---|---|---|---|
| 2,177,898 | 10/1939 | Leguillon et al. | 15/88.3 |
| 2,269,658 | 1/1942 | George et al. | 15/88.3 |
| 2,576,333 | 11/1951 | Earll . | |
| 2,682,065 | 6/1954 | Nelson et al. | 15/88.3 |
| 4,428,160 | 1/1984 | Willemsen et al. . | |
| 4,930,261 | 6/1990 | Tiegs et al. . | |
| 4,987,701 | 1/1991 | Humbert . | |

*Primary Examiner*—Edward L. Roberts
*Attorney, Agent, or Firm*—Learman & McCulloch

[57] ABSTRACT

A poppet valve cleaner 10 includes a frame 20, a poppet valve brush assembly and a carriage assembly. The poppet valve brush assembly includes a drive motor 32 and a pair of cup shaped steel wire brushes 44 and 46 driven by the motor. The carriage assembly includes a carriage support shaft 54 and a carriage plate 64 that is pivotally and slidably attached to the carriage support shaft. A chuck assembly 86 is mounted on the carriage plate 64. A drive roller 138 is mounted in the side walls 88 and 90 of the chuck assembly and is rotated by an electric motor 144. A valve stem 14 is positioned between idler rollers 96 and 98 and compression roller 108 that is biased toward the idler rollers by a compression spring 134. The idler rollers 96 and 98 are driven by drive roller 138 to rotate the poppet valve. The carriage plate 64 is manually movable to position the valve head 16 between the steel wire brushes 44 and 46 and to move surfaces of the valve into contact with the brushes to remove carbon from the valve. After carbon is removed, the handle 84 is moved to the left and down to release the chuck 86, to pivot rollers 166 and 168 away from the valve, and to move the second shield 182 away from the poppet valve thereby allowing removal of a cleaned valve.

16 Claims, 4 Drawing Sheets

POPPET VALVE CLEANER

TECHNICAL FIELD

The invention relates to a valve cleaner and more particularly to a machine for removing carbon and other deposits from a poppet valve of an internal combustion engine.

BACKGROUND OF THE INVENTION

Poppet valves are employed in internal combustion engines to admit air or air and fuel mixtures into a cylinder during an intake stroke, to let exhaust gasses out of cylinders during an exhaust stroke and to close a cylinder during compression and power strokes of a piston. The standard internal combustion engine has an intake poppet valve and an exhaust poppet valve for each cylinder. Large internal combustion engines and some high performance engines have multiple intake and exhaust poppet valves for each cylinder.

During the compression and power strokes of an internal combustion engine, poppet valves must make sealing contact with a valve seat to seal the cylinders. Failure to seal a cylinder will result in loss of efficiency and power. A bad leak may prevent an internal combustion engine from running. During a major overhaul of an internal combustion engine, the valve faces of the poppet valves are ground and polished in a valve grinder and the valve seats, which the poppet valves contact to seal the cylinders, are refaced with precision high seed grinding stones.

Poppet valves operate in very hostile environments. They are subjected to high temperatures, high pressures and the products of combustion. Deposits of carbon and other materials build up on the surfaces of a valve head and on portions of the valve stems adjacent to the valve head that are exposed to products of combustion. Most of the deposits are on the exhaust valve. However, there are deposits on the intake valve too. These deposits must be removed before the valve faces can be ground and polished. Failure to remove the deposits prior to grinding the valve face will reduce the useful life of the grinding stone and may interfere with the valve face grinding process.

Deposits of carbon and other material are commonly removed from poppet valves by hand holding the valves against a rotating wire wheel. A slight slip when holding a valve against a rotating wire wheel can result in contact between the hand and the rotating wire wheel and a hand injury. Hand cleaning, in addition to being dangerous, is slow. It takes substantial time to manually manipulate a valve to bring all surfaces with deposits into contact with a rotating wire brush and to remove the surface deposits. Poppet valves are also cleaned in dunk tanks with small metal balls and chemical cleaners. The chemical cleaners are expensive and produce vapors. Direct contact with the chemicals and with the vapors can cause injuries to workers that are cleaning poppet valves. Disposal of the chemicals after they become too contaminated for further use is expensive and can be difficult. The valve stems can be damaged by the metal balls and the toxic chemicals. A damaged valve stem surface will damage engine valve guides and lead to oil consumption and engine failure.

SUMMARY OF THE INVENTION

An object of the invention is to provide a fast and efficient poppet valve cleaner which mechanically removes surface deposits.

A further object of the invention is to provide a method for efficiently cleaning poppet valves.

Other objects and advantages of the invention will become apparent with reference to the accompanying drawings and the accompanying descriptive matter.

THE DRAWINGS

DETAILED DESCRIPTION

Figure 1:
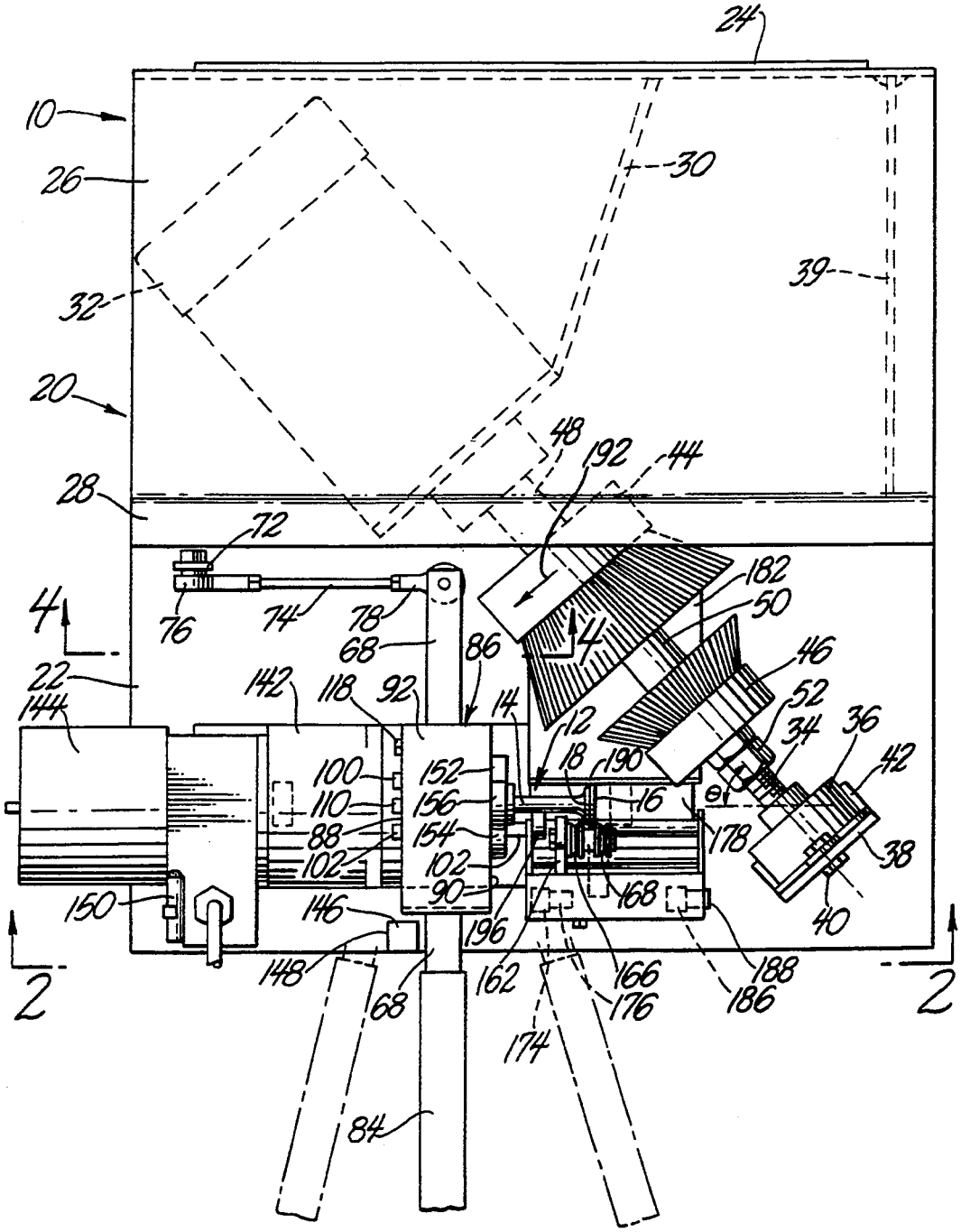
FIG. 1 is a top plan view of a poppet valve cleaner.

The poppet valve cleaner 10 for cleaning a poppet valve 12 with a valve stem 14, a valve head 16, and a valve face 18 has a frame 20. The frame 20 includes a flat horizontal base 22, a vertical rear wall 24, and a partial top wall 26. The top wall 26 covers the rear portion of the poppet valve cleaner 10 and has a downwardly and forwardly inclined front lip 28. A support rib 29 provides additional support for the partial top wall 26. The support rib 29 is attached to the base 22, the vertical rear wall 24 and the top wall 26.

A motor support plate 30 extends vertically up from the flat horizontal base 22 and is welded to the base, the vertical rear wall 24 and the partial top wall 26. A brush drive motor 32 is secured to one side of the motor support plate 30. A spindle extension 34 of the motor output shaft passes through an aperture in the motor support plate 30. The free end of the spindle extension 34 is supported by a bearing assembly 36 attached to a vertical bar 38 by bolts 40. The vertical bar 38 is welded to the horizontal base 22 and reinforced by a block 42. Two cup shaped steel wire brushes 44 and 46 are secured to the spindle extension 34. The larger cup-shaped steel wire brush 44 is positioned along the length of the spindle extension 34 by a sleeve 48. Sleeves 48 of various lengths are provided to adjust the position of the larger cup-shaped steel wire brush 44. A sleeve 50 is placed on the spindle extension 34 between the cup-shaped steel wire brushes 44 and 46. Sleeves 50 of different lengths can be used to adjust the distance between the two cup-shaped steel wire brushes 44 and 46. The steel wire brushes 44 and 46 are secured to the spindle extension 34 and locked in place by nuts 52. There is normally no need to adjust the position of the cup-shaped steel wire brushes 44 and 46 along the length of the spindle extension 34 or to change the space between the two steel wire brushes 44 and 46. The adjustment is provided so that the poppet valve cleaner 10 can be used to clean exceptionally small or large valves. The open sides of the two cup-shaped steel wire brushes 44 and 46 face each other. The smaller cup-shaped steel wire brush 46 could be replaced by a steel wire brush with radially extending steel wires. It is believed that the cup-shaped steel wire brush works best, however. Mounting both cup-shaped steel wire brushes 44 and 46 on one spindle extension 34 insures that both brushes rotate together at the same speed and that the space between the two steel wire brushes remains fixed until the sleeve 50 is exchanged for a sleeve with a different length. The common mounting on one spindle extension simplifies construction, adjustments and operation of the poppet valve cleaner 10.

Figure 5:
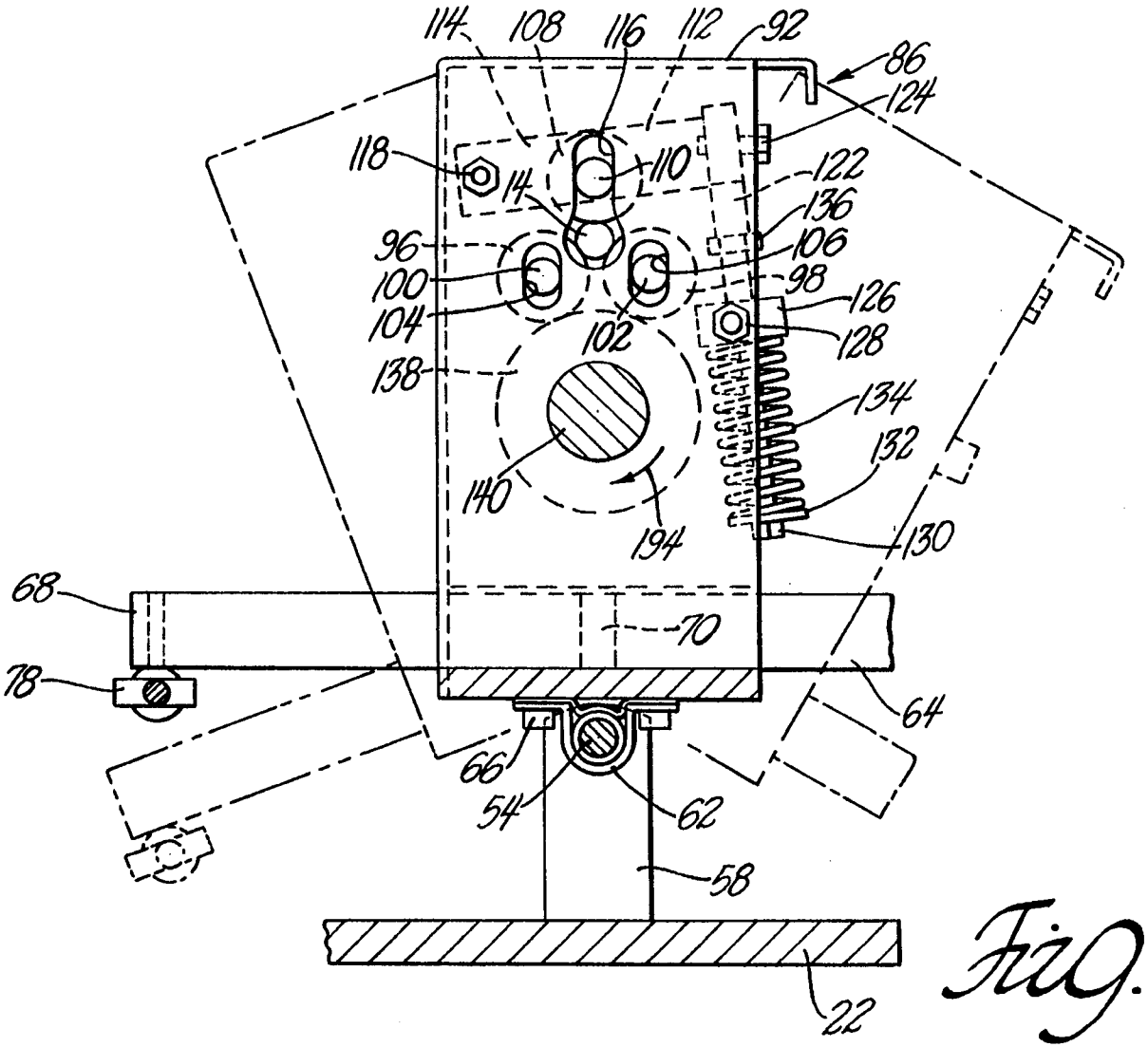
FIG. 5 is a cross-sectional view taken along line 5—5 in FIG. 2.

A carriage support shaft 54 is horizontally mounted above the horizontal base 22 on the upper ends of posts 56 and 58. The posts 56 and 58 are welded to the horizontal base 22. The carriage support shaft 54 is secured to the posts 56 and 58 by bolts 60. A pair of carriage brackets 62 are rotatably and slidably journaled on the carriage support shaft 54. A carriage plate 64 is secured to the carriage brackets 62 by bolts 66. A control arm 68 is pivotally attached to the carriage plate 64 by a pin 70. One end of the control arm 68 is anchored to an upright post 72 by an adjustable link 74. The upright post 72 is rigidly secured to the flat horizontal base 22 by welding or by fasteners. The adjustable link 74 includes a ball joint 76 bolted to the upright post 72 and a ball joint 78 bolted to one end of the control arm 68. A shaft portion 80 of the adjustable link 74 is threaded on both ends and screws into and out of the ball joints 76 and 78 to adjust the length of the adjustable link 74. Lock nuts 82 prevent rotation between the shaft portion 80 and the ball joints 76 and 78 when the length of the adjustable link 74 is properly set. Manually moving the handle 84 of the control arm 74 to the right or left as indicated by phantom line positions in FIG. 1 slides the carriage plate 64 along the carriage support shaft 54 and parallel to the axis of the carriage support shaft. Manually moving the handle 84 of the control arm 74 up and down as indicated by phantom line positions in FIG. 5 rotates the carriage plate 64 about the axis of the carriage support shaft 54.

A valve stem chuck assembly 86 is rigidly secured to and extends upwardly from the carriage plate 64. The valve stem chuck assembly 86 includes a pair of side walls 88 and 90, a top wall 92, and an intermediate wall 94. The intermediate wall supports one end of the pin 70 that pivotally attaches the control arm 68 to the carriage plate 64. The side walls 88 and 90 are spaced some distance apart and permit the control arm 68 to pivot a substantial number of degrees about the axis of the pin 70. Idler rollers 96 and 98 are mounted on idler roller shafts 100 and 102, and between the side walls 88 and 90. The idler roller shafts 100 and 102 extend through vertical slots 104 and 106 in the side walls 88 and 90. The vertical slots 104 and 106 allow the idler rollers 96 and 98 to float up and down within limits. A rotatable compression roller 108 is mounted on a shaft 110 above and between the idler rollers 96 and 98. The shaft 110 passes through bores in the arms 112 of a U-shaped compression roller support 114 and through slots 116 in the side walls 88 and 90 of the valve stem chuck assembly 86. The free ends of the arms 112 of the U-shaped compression roller support 114 are pivotally attached to the side walls 88 and 90 by a bolt 118. The base 120 of the U-shaped compression roller support 114 is connected to a ball connector 122 by a bolt 124. A bar 126 is pivotally attached to the side walls 88 and 90 by bolts 128. A long tension bolt 130 extends up through a washer 132, a coiled compression spring 134, a bore through the center of bar 126 and screws into the ball connector 122. A lock nut 136 locks the long tension bolt 130 relative to the ball connector 122 in a position which provides the desired compression of compression spring 134 and the desired load on the rotatable compression roller 108.

A drive roller 138 is mounted between the side walls 88 and 90 on a driven shaft 140. The driven shaft 140 is the output shaft of a speed reduction gear box 142 which is secured to the carriage plate 64. The speed reduction gear box 142 is driven by an electric motor 144.

The valve stem chuck assembly 86 as described above is simple, relatively inexpensive and works well. However, there are many chuck assemblies that could replace the valve stem chuck assembly 86 in the poppet valve cleaner 10. An air operated chuck which uses air pressure to open and close the chuck to release or hold a valve stem 14 could be used in place of the valve stem chuck assembly 86.

The axis of rotation of the spindle extension 34 is at an angle of about 50° from the axis of rotation of the valve stem 14 of a poppet valve 12. This angle provides an opening for the valve head 16 of a poppet valve to be moved to a position between the two cup-shaped steel wire brushes 44 and 46. The use of the steel wire brushes with different designs may make it desirable to change the angle between the axis of rotation of the spindle extension 34 and the axis of rotation of the valve stem 14. Such an adjustment can be accommodated by adjustably mounting the brush drive motor 32 or the carriage support shaft 54 to provide pivotal movement about a vertical axis. Parts related to or associated with either the brush drive motor 32 or the carriage support shaft 54 would need to be repositioned as required to positions in which they could perform their functions.

The axis of rotation of the spindle extension 34, as shown in the drawing, is in a fixed horizontal plane. The axis of rotation of the valve stem 14, when mounted in the valve stem chuck assembly 86, is also in a horizontal plane. Pivotal movement of the carriage plate 64 about the axis of the carriage support shaft 54 raises and lowers the axis of rotation of the valve stem 14 relative to the fixed horizontal plane containing the axis of rotation of the spindle extension 34. If desired, adjustments can be provided to adjust the angle of the axis of rotation of the spindle extension 34 or the axis of rotation of the valve stem 14 relative to a horizontal plane. It would also be possible to provide adjustment of the angle of rotation of the axis of rotation of the spindle extension 34 and the axis of rotation of the valve stem 14 relative to a horizontal plane. Horizontal and vertical adjustment of the axis of rotation of the spindle extension 34 or the axis of rotation of the valve stem 14 could also be provided if desired. Such adjustments may, for example, facilitate the cleaning of a valve head 16 that has a concave or convex surface rather than the normal flat surface. Such adjustments may also make it possible to clean exceptionally large or small poppet valves 12 which could not otherwise be cleaned by the poppet valve cleaner 10.

To place the poppet valve cleaner 10 into operation, the handle 84 of the control arm 74 is moved to the left and down so that the head end of the long tension bolt 130 contacts the upper end surface 146 of the fixed cam 148, the compression spring 134 is compressed and the compression roller 108 and shaft 110 are raised in the slot 116. Raising the compression roller 108 by pivoting the U-shaped compression roller support 114 about the axis of the bolt 118 opens the lower enlarged end of the slots 116 through the side walls 88 and 90. The valve stem 14 of a poppet valve 12 is then inserted into the lower ends of the slots 116 in the valve stem chuck assembly 86. When the handle 84 of the control arm 74 is raised and the head end of the long tension bolt 130 is raised from the upper end surface 146 of the fixed cam 148, the compression spring 134 pivots the U-shaped compression roller support 114 about the axis of the bolt 118 and forces the compression roller 108 against the valve stem 14. The valve stem 14 is forced into contact with idler rollers 96 and 98 and the idler rollers, which are free to move in the vertical slots 104 and 106, are forced into contact with the drive roller 138. The force exerted on the drive roller 138 by the idler rollers 96 and 98 is proportional to the tension on compression spring 134. The drive roller 138 rotates the idler rollers 96 and 98 which rotate the valve stem 14. The rotation of the valve stem 14 rotates the compression roller 108.

A mercury switch 150 on the electric motor 144 turns the motor off and stops rotation of the drive roller 138 when the handle 84 is lowered past a predetermined position. When the handle 84 is raised to lift the long tension bolt 130 out of contact with the upper end surface 146 on the fixed cam 148, the mercury switch 150 turns the electric motor 144 on and the drive roller 138 rotates the poppet valve 12.

The idler rollers 96 and 98 and the compression roller 108 as shown in the drawing have relatively small diameters and extend from the side wall 88 to the side wall 90. Larger diameter rollers could be used in place of the idler rollers 96 and 98 and the compression roller 108 by dividing some of the rollers into two or more separate rollers and arranging the rollers on some of the shafts 100, 102 and 110 to run between rollers on other shafts. The diameter of valve stems 14 varies depending upon the size of the internal combustion engine they are used in. To clean poppet valves with small diameter valve stems 14 it may be necessary to employ separate rollers on some of the shafts 100, 102 or 110 that run either between or at the end of rollers on other shafts in the valve stem chuck assembly 86.

Figure 2:
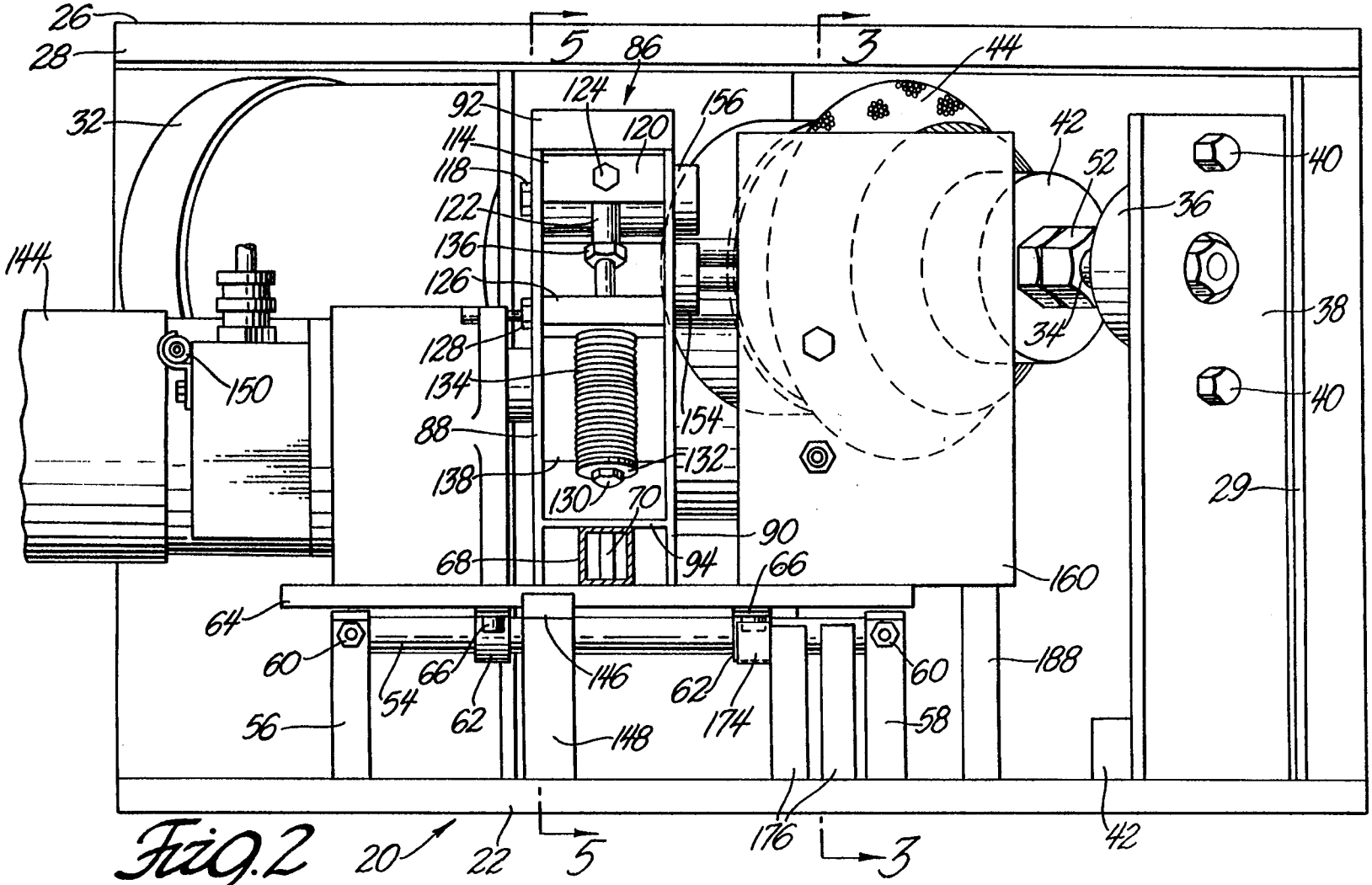
FIG. 2 is an enlarged sectional view taken along line 2—2 of FIG. 1 with parts broken away.

The idler roller shafts 100 and 102 extend through the side wall 90 and support idler rollers 152 and 154 adjacent to the outside surface of the side wall. The shaft 110 for the compression roller 108 also extends through the side wall 90. When relatively small diameter rollers 96, 98 and 108 are used, a compression roller 156 as shown in FIGS. 1 and 2 can be mounted on the end of the shaft 110 adjacent to the outside surface of the side wall 90. If relatively large diameter idler rollers 96 and 98 and compression roller 108 are employed as described above, the idler rollers 152 and 154 and the compression roller 156 will require some axial offset relative to each other.

A shield support assembly 160 is secured to the carriage plate 64 and spaced from the side wall 90 of the valve stem chuck assembly 86 opposite the reduction gear box 142 and the electric motor 144. The shield support assembly 160 carries a bell crank 162 which is pivotally mounted on a shaft 164. The upper end of the bell crank 162 carries freely rotating spaced apart rollers 166 and 168. During operation of the poppet valve cleaner 10, the valve head 16 of a poppet valve 12 that is being cleaned is positioned between the freely rotating spaced apart rollers 166 and 168. The freely rotating roller 168 contacts the top of the valve head 16 during the cleaning operation to keep the poppet valve 12 from being pulled out of the valve stem chuck assembly 86. The freely rotating roller 166 contacts the bottom of the valve head 16 during the cleaning operation to keep the poppet valve 12 from being forced too far into the valve stem chuck assembly 86. A compression spring 170 biases the upper end of the bell crank 162 and the freely rotating rollers 166 and 168 toward the valve head 16 of a poppet valve 12. Movement of the handle 84 on the control arm 74 to the left and down moves the cam surface 172 on the lower end of the bell crank 162 into contact with a cam roller 174. The cam roller 174 is rotatably supported on a post 176 that is welded to the flat horizontal base 22. Continued downward movement of the handle 84 results in the cam roller 174 rolling on the cam surface 172 and rotating the bell crank 162 about the shaft 164 thereby compressing the compression spring 170 and moving the freely rotating spaced apart rollers 166 and 168 away from the valve head 16. When the freely rotating spaced apart rollers 166 and 168 are moved away from the poppet valve 12 and the compression roller 108 has been lifted by the fixed cam 148 as explained above, a cleaned poppet valve 12 can be removed from the valve stem chuck assembly 86 and another poppet valve can be inserted in the valve stem chuck assembly 86 to be cleaned. Lifting the handle 84 will move the cam surface 172 away from the cam roller 174 and allow the compression spring 170 to swing the freely rotating spaced apart rollers 166 and 168 to a poppet valve retaining position as shown in FIG. 1.

Figure 3:
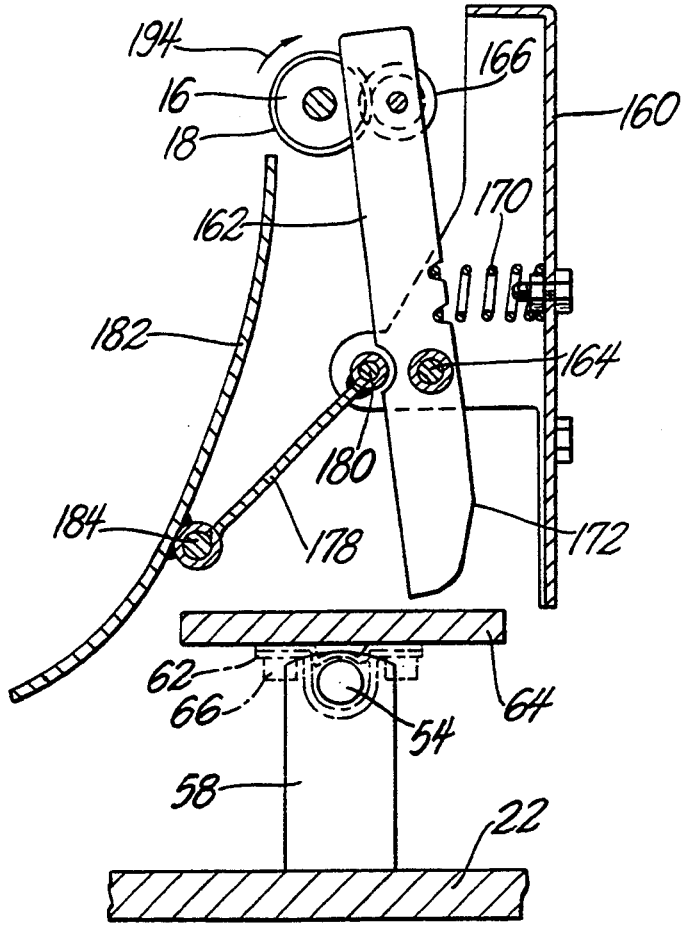
FIG. 3 is a cross-sectional view taken along line 3—3 in FIG. 2.
Figure 4:
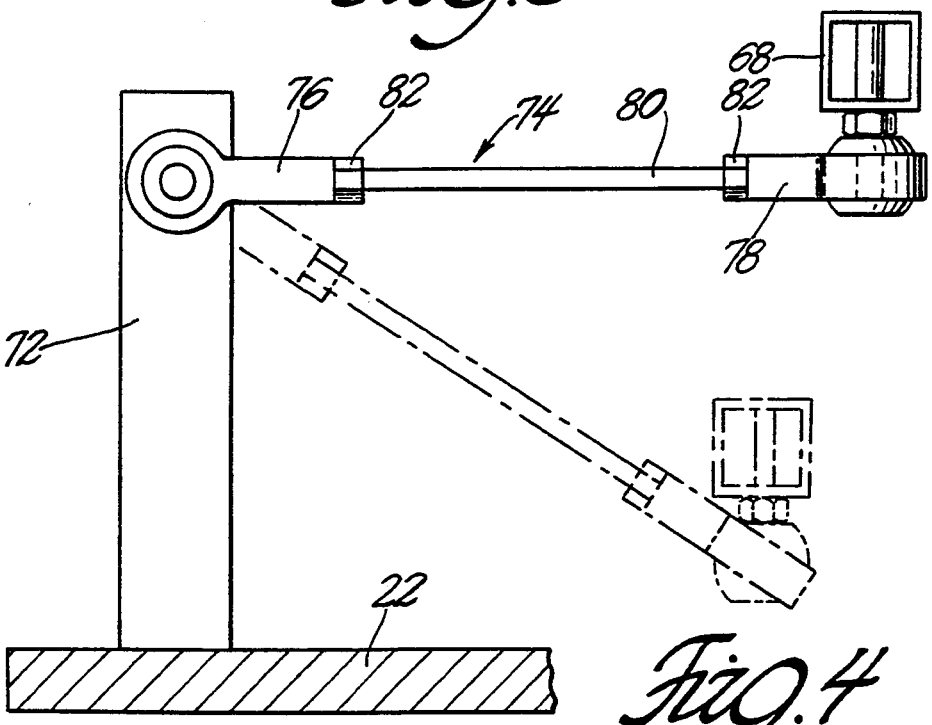
FIG. 4 is an enlarged sectional view of the anchor for the carriage control arm taken along line 4—4 in FIG. 1.

A first shield 178 is pivotally attached to the shield support assembly 160 by a pin 180. A second shield 182 is pivotally attached to the first shield 178 by a pin 184. When the handle 84 on the control arm 74 is moved downward, the first shield 178 contacts a roller 186 on a cam support 188. The cam support 188 is rigidly secured to the flat horizontal base 22. Downward movement of the handle 84 after the first shield 178 contacts the roller 186 moves the first shield clockwise about the pin 180 as shown in FIG. 3. As the first shield 178 moves clockwise, the second shield 182 moves counterclockwise about the pin 84 and the upper end of the second shield 182 moves away from the poppet valve 12. The lower end of the second shield 182 slides along the upper surface of the flat horizontal base 22. A slot 190 in the upper edge of the second shield 182 provides a passage for the valve head 16 when the valve head and the valve stem 14 move into contact with the cup shaped steel wire brushes 44 and 46. The purpose of the first and second shields 178 and 182 is to direct carbon and other material, removed from poppet valves 12 by the cup-shaped steel wire brushes 44 and 46, to the rear and away from an operator of the poppet valve cleaner 10.

During operation of the poppet valve cleaner 10, the handle 84 is moved to the left and down, a valve is inserted into the bottom of the slots 116 through the side walls 88 and 90 of the valve stem chuck assembly 86 and the motor 32 is turned on to rotate the cup-shaped steel wire brushes in the direction indicated by arrow 192 in FIG. 1. Lifting the handle 84 clamps the valve stem 14 in the valve stem chuck assembly 86 and turns on the motor 144. The motor 144 rotates the drive roller 138 in the direction indicated by arrow 194 in FIG. 5. The operator moves the handle 84 to the right to slide the carriage plate 64 to the right on the carriage support shaft 54. When the top of the valve head 16 makes contact with the smaller cup-shaped steel wire brush 46, the handle 84 is raised to move the valve head in an arcuate path and toward the rear of the frame 20. This movement of the poppet valve relative to the rotating cup-shaped steel wire brush 46 cleans the entire top surface of the valve head 16. The pressure exerted on the cup-shaped steel wire brush 46 can be controlled by moving the handle 84 to the right or left.

After the top of the valve head 16 is cleaned, the handle 84 is raised until the valve stem 14 contacts the large cup-shaped steel wire brush 44. Once contact is made between the valve stem 14 and the cup-shaped steel wire brush, the handle 84 is moved to the left to clean the upper part of the valve stem 14. Continued movement of the handle 84 to the left brings the bottom surface of the valve head 16 into contact with the cup-shaped steel wire brush 44. Downward movement of the handle 84 will move contact between the steel wire brush and the bottom surface of the valve head 16 from the center portion of the valve outwardly and clean the bottom surface of the valve head and the valve face. Manipulation of the handle 84 will bring all surfaces of the valve head 16 and the upper portion of the valve stem into contact with the cup-shaped steel wire brushes 44 and 46. If necessary, some areas can be brushed a second time to remove all the carbon and other material deposited on the surface of the poppet valve 12.

Following the removal of deposits from a poppet valve 12, the handle 84 is moved to the left and down. The downward movement compresses the coil compression spring 134, raises the compression roller 108, moves the compression roller 108 away from the freely rotating spaced apart rollers 166 and 168 and away from the poppet valve 12, moves the second shield 182 away from the poppet valve, and turns the motor 144 off. The poppet valve 12 can then be removed from the valve stem chuck assembly 86 and another poppet valve that requires cleaning can be inserted in the chuck assembly.

The cup-shaped steel brushes 44 and 46 can exert substantial force on a poppet valve 12 during cleaning. This force may be sufficient to bend a valve stem 14 if the operator exerts too much force on the handle 84. Extending the idler roller shaft 102 and mounting a roller 196 of the idler roller shaft 102 adjacent to the valve head 16 can eliminate the possibility of bending a valve stem 14.

The brush drive motor 32 rotates the cup-shaped steel wire brushes 44 and 46 in the direction indicated by the arrow 192 in FIG. 1. The poppet valve 12 is rotated in a direction indicated by the arrow 194 in FIG. 3. The poppet valve 12 is rotated at a slow speed relative to the speed of the steel wire brushes 44 and 46. Rotation of the brushes 44 and 46 and rotation of a poppet valve in the directions indicated results in a major portion of the carbon and other material removed from the poppet valve being thrown downwardly toward the second shield 182.

It is to be understood that the embodiments described are exemplary of various forms of the invention only and that the invention is defined in the appended claims which contemplate various modifications within the spirit and scope of the invention.

I claim:

1. A poppet valve cleaner for cleaning a poppet valve having a valve stem with a valve head, the head having a valve head top surface, a valve head bottom surface, and a valve face, the cleaner including a frame; a chuck mounted on the frame for holding the valve stem of a poppet valve and rotating the poppet valve about a valve stem axis; a pair of spaced apart wire brushes rotatably supported on the frame for rotation about a common brush axis of rotation that is at an angle to the valve stem axis; a carriage assembly mounted on the frame and manipulatable to move the poppet valve relative to the wire brushes to position at least a portion of the valve head between the spaced apart wire brushes, to bring the top surface of the head of a poppet valve into contact with one of the wire brushes and to bring the bottom surface of the head of a poppet valve into contact with the other wire brush; a drive assembly attached to the frame and operable to rotate the poppet valve about the valve axis; and a drive assembly attached to the frame and operable to rotate the wire brushes about the brush axis of rotation.

2. A poppet valve cleaner, as set forth in claim 1, wherein the chuck is mounted on the carriage assembly.

3. A poppet valve cleaner, as set forth in claim 2, wherein the carriage assembly includes a carriage support shaft and a carriage pivotally and slidably attached to the carriage support shaft.

4. A poppet valve cleaner, as set forth in claim 3, including a handle attached to the carriage which is operable to pivot the carriage about the axis of the carriage support shaft and to slide the carriage along an axis of the carriage support shaft.

5. A poppet valve cleaner, as set forth in claim 1, wherein the drive assembly for rotating the wire brushes includes a brush drive motor for rotating the spaced apart wire brushes and the drive assembly for rotating the poppet valve includes a motor for rotating the poppet valve in the chuck.

6. A poppet valve cleaner, as set forth in claim 1 wherein the chuck includes a poppet valve positioning assembly which positions the valve head of a poppet valve.

7. A poppet valve cleaner, as set forth in claim 1, including a shield assembly for directing carbon and other material, removed from a poppet valve, away from the chuck.

8. A poppet valve cleaner, as set forth in claim 7 including at least one cam for moving the shield assembly away from a poppet valve during removal of a poppet valve from the chuck.

9. A poppet valve cleaner as set forth in claim 1 wherein the angle between the brush axis of rotation and the valve axis is an acute angle.

10. A poppet valve cleaner including a frame; a poppet valve cleaning brush assembly including a brush drive motor attached to the frame, a spindle driven by the brush drive motor and a pair of brushes mounted on the spindle; a carriage assembly including a carriage support shaft attached to the frame, a carriage slidably and rotatably attached to the support shaft, a poppet valve chuck assembly secured to the carriage, a motor mounted on the carriage operable to rotate a poppet valve in the poppet valve chuck assembly; and a handle attached to the carriage which is manually movable to position a poppet valve head between the two brushes and to move the carriage to clean the valve head top, the valve head bottom and the valve stem adjacent to the valve head.

11. A poppet valve cleaner for cleaning a poppet valve having a valve stem with a valve head, the head having a valve head top surface, a valve head bottom surface, and a valve face, comprising a frame; a chuck for holding the valve stem of a poppet valve and rotating the poppet valve about an axis of the valve stem supported by the frame; at least one wire brush rotatably supported by the frame for rotation about a brush axis of rotation; a drive assembly attached to the frame and operable to rotate the poppet valve about the axis of the valve stem; a drive assembly attached to the frame and operable to rotate the at least one wire brush about the brush axis of rotation; and a carriage assembly mounted on the frame and supporting the chuck for movement toward and away from the at least one wire brush and wherein the carriage assembly is manipulatable to move the poppet valve relative to the wire brush to move the valve head bottom surface and a portion of the valve stem into contact with said at least one wire brush to clean the valve head bottom surface and a portion of the valve stem.

12. A poppet valve cleaner as set forth in claim 11 including a second wire brush rotatably supported by the frame for rotation about said brush axis of rotation; and wherein the carriage assembly is manipulatable to move the poppet valve relative to the wire brush to move the valve head top surface into contact with said second wire brush to clean the valve head top surface.

13. A poppet valve cleaner as set forth in claim 12 wherein said at least one wire brush and said second wire brush are mounted on a common spindle.

14. A poppet valve cleaner as set forth in claim 13 wherein the second wire brush is axially spaced on the common spindle from said at least one wire brush.

15. A poppet valve cleaner as set forth in claim 11 wherein said brush axis of rotation is at an acute angle relative to said axis of the valve stem.

16. A poppet valve cleaner as set forth in claim 11 wherein the carriage assembly is operable to move the poppet valve back and forth parallel to the axis of the valve stem and to move the poppet valve back and forth perpendicular to the axis of the valve stem.

* * * * *